US007644947B2

(12) United States Patent
Girard et al.

(10) Patent No.: US 7,644,947 B2
(45) Date of Patent: Jan. 12, 2010

(54) DEVICE FOR BINDING A BOOT TO A SPORTS ARTICLE HAVING A SEPARATE ELASTIC RETURN SYSTEM

(75) Inventors: François Girard, Veyrier du Lac (FR); Eddy Yelovina, Seynod (FR); Bruno Lancon, Villy le Pelloux (FR)

(73) Assignee: Salomon S.A.S., Metz-Tessy (FR)

( * ) Notice: Subject to any disclaimer, the term of this patent is extended or adjusted under 35 U.S.C. 154(b) by 95 days.

(21) Appl. No.: 11/175,150

(22) Filed: Jul. 7, 2005

(65) Prior Publication Data

US 2006/0012151 A1 Jan. 19, 2006

(30) Foreign Application Priority Data

Jul. 13, 2004 (FR) ..... 04 07834

(51) Int. Cl.
*A63C 9/18* (2006.01)

(52) U.S. Cl. ..... 280/615; 280/613

(58) Field of Classification Search ..... 280/11.15, 280/614, 615, 619, 622, 637; 36/117.3
See application file for complete search history.

(56) References Cited

U.S. PATENT DOCUMENTS

| | | | | | |
|---|---|---|---|---|---|
| 2,172,669 | A | * | 9/1939 | Taft | 280/614 |
| 3,844,575 | A | | 10/1974 | Salomon | 280/11.35 N |
| 3,863,942 | A | | 2/1975 | Burger | 280/11.35 Z |
| 3,997,188 | A | * | 12/1976 | Begey | 280/613 |
| 4,410,200 | A | * | 10/1983 | Näpflin | 280/618 |
| 5,085,454 | A | | 2/1992 | Provence et al. | 280/615 |
| 5,090,723 | A | * | 2/1992 | Arnulf | 280/615 |
| 5,152,546 | A | | 10/1992 | Dunand et al. | 280/615 |
| 5,228,714 | A | * | 7/1993 | Dekanovsky | 280/615 |
| 5,310,206 | A | | 5/1994 | Eugler et al. | 280/615 |
| 5,366,235 | A | | 11/1994 | Eugler et al. | 280/622 |
| 5,924,719 | A | * | 7/1999 | Girard | 280/615 |
| 6,017,050 | A | | 1/2000 | Girard | 280/615 |
| 6,113,111 | A | | 9/2000 | Gierveld et al. | 280/11.15 |
| 6,152,458 | A | | 11/2000 | Edauw et al. | 280/11.14 |
| 6,374,517 | B2 | | 4/2002 | Girard et al. | 36/117.3 |
| 6,499,761 | B1 | | 12/2002 | Quellais | 280/623 |
| 2001/0015024 | A1 | | 8/2001 | Girard et al. | 36/117.3 |
| 2003/0168830 | A1 | | 9/2003 | Haughlin | 280/615 |
| 2004/0164519 | A1 | * | 8/2004 | Quellais et al. | 280/615 |
| 2004/0262886 | A1 | | 12/2004 | Girard | 280/615 |

FOREIGN PATENT DOCUMENTS

| | | |
|---|---|---|
| DE | 41 43 410 A1 | 7/1993 |
| EP | 0 768 103 A1 | 4/1997 |

(Continued)

*Primary Examiner*—Frank B Vanaman
(74) *Attorney, Agent, or Firm*—Greenblum & Bernstein P.L.C.

(57) ABSTRACT

A device for binding a boot to a sports article, of the type including a retaining system through which the boot is fixed to the sports article with a possibility to move relative to the sports article, between a low position and a high position, of the type including a system for the elastic return of the boot toward its low position, and of the type in which the retaining system functions independently of the elastic return system, and in which the elastic return system is part of a pre-assembled unitary module.

44 Claims, 6 Drawing Sheets

FOREIGN PATENT DOCUMENTS

| | | | |
|---|---|---|---|
| EP | 0 890 379 | B1 | 1/1999 |
| EP | 0 914 844 | B1 | 5/1999 |
| FR | 2 363 341 | A1 | 3/1978 |
| FR | 2 634 132 | A1 | 1/1990 |
| FR | 2 650 192 | A1 | 2/1991 |
| NL | 8 602 796 | A | 6/1988 |
| WO | WO - 96/37269 | A1 | 11/1996 |
| WO | WO - 99/02226 | A1 | 1/1999 |
| WO | WO - 00/13755 | A1 | 3/2000 |
| WO | WO - 01/93963 | A1 | 12/2001 |

* cited by examiner

DEVICE FOR BINDING A BOOT TO A SPORTS ARTICLE HAVING A SEPARATE ELASTIC RETURN SYSTEM

CROSS-REFERENCE TO RELATED APPLICATION

This application is based upon French Patent Application No. 04.07834, filed on Jul. 13, 2004, the disclosure of which is hereby incorporated by reference thereto in its entirety and the priority of which is hereby claimed under 35 U.S.C. 119.

BACKGROUND OF THE INVENTION

1. Field of the Invention

The present invention relates to a device for binding an article of footwear, such as a boot or a shoe, to a sports article, particularly to a gliding apparatus, such as a ski or a skate.

The invention also applies, in particular, to devices for binding a boot to a ski. In particular, it can be implemented in the design of bindings for cross-country skiing, alpine ski touring, Nordic ski touring or telemark skiing.

2. Description of Background and Relevant Information

An example of bindings of the aforementioned type is that of the cross country ski bindings marketed by Salomon S.A. under the trademark SNS Pilot® and described in the document EP 768 103 and in U.S. Pat. No. 6,017,050. In this type of binding, the boot is articulated by its front end about a transverse axis with respect to the ski, by means of a retaining system forming a jaw in which an articulation rod affixed to the boot sole is received.

The invention can also be applied in the context of a device such as described in the documents WO 00/13755, U.S. Pat. No. 6,499,761, EP 890 379, WO 96/37269, EP 914 844, U.S. Pat. No. 6,152,458, WO 01/93963, and U.S. patent application Publication No. 2003/0168830. In these types of bindings, the boot is retained on a connecting member connected to the remainder of the device by a mechanism that sets it, and the boot, on a particular path of movement between high and low positions.

The bindings to which the invention applies are to be distinguished from cable bindings of the types described, for example, in the documents U.S. Pat. No. 3,863,942, WO 99/02226, FR 2 363 341, and U.S. Pat. No. 3,844,575. These cable bindings are generally adapted for alpine skiing or telemark skiing. In either case, they include a stirrup arranged at the front, as well as a cable that is adapted to extend around the rear portion of the boot and to be tensioned in order to push the boot forward in support against the stirrup. Although the cable can possibly cause an elastic return effect, this effect is not the main effect desired, and it generally only occurs at the end the range of boot flexing. Indeed, the cable mainly acts as a boot retaining member within the retaining system constituted by the abutment and the cable. In this way, because the cable is primarily designed for its retention function, the return is generally arranged near the boot flexing point, which is approximately the center of rotation of the movement of the boot heel relative to the ski. As a result, because the return is arranged substantially in the area of this center of rotation, the cable only transmits a slight displacement to the spring, and the variation in this displacement with respect to the angular position of the heel varies only slightly; in addition, this variation is not truly controlled. In this way, the variation in the return force cannot be completely controlled. For certain positions of the boot, the return force can be almost zero; even negative. It has been noted that this control cannot be achieved when the retaining system and the elastic return system are not independent, as is the case in the prior art cable bindings in which, without the cable, the boot is no longer retained on the ski.

SUMMARY OF THE INVENTION

An object of the invention is to improve the bindings having a boot retaining system that carries out its function independently of an elastic return system. Indeed, particularly for cross-country skiing, the binding must have an elastic return system that brings the boot back toward its low position, which corresponds to its position when it is in front and rear support on the ski. This elastic return system must be sufficiently powerful to quickly bring the boot back to this low position. However, this elastic return system must also be adequately progressive in the increase of force as a function of the boot lift angle, and its action must not oppose too much resistance against the foot rolling movement.

Another object of the invention is to provide an elastic return system of a binding device according to the invention that is neither cumbersome nor too heavy.

Finally, in terms of a particular construction, an object of the invention is to provide an elastic return system of a binding device according to the invention that must be completely integrated into the remainder of the binding device, while allowing for a simple, accurate and reliable mounting of the device.

In order to address these objects, the invention encompasses a device for binding a boot to a sports article, of the type including a retaining system through which the boot is fixed to the sports article with a possibility that the boot move relative to the sports article, between a low position and a high position, of the type including a system for the elastic return of the boot toward its low position, and of the type in which the retaining system functions independently of the elastic return system, with the elastic return system being affixed to, or integrated within, a pre-assembled self-contained module.

BRIEF DESCRIPTION OF DRAWINGS

Other characteristics and advantages of the invention will become apparent upon reading the following description, with reference to the attached drawings, in which.

DETAILED DESCRIPTION OF THE INVENTION

Figure 1:
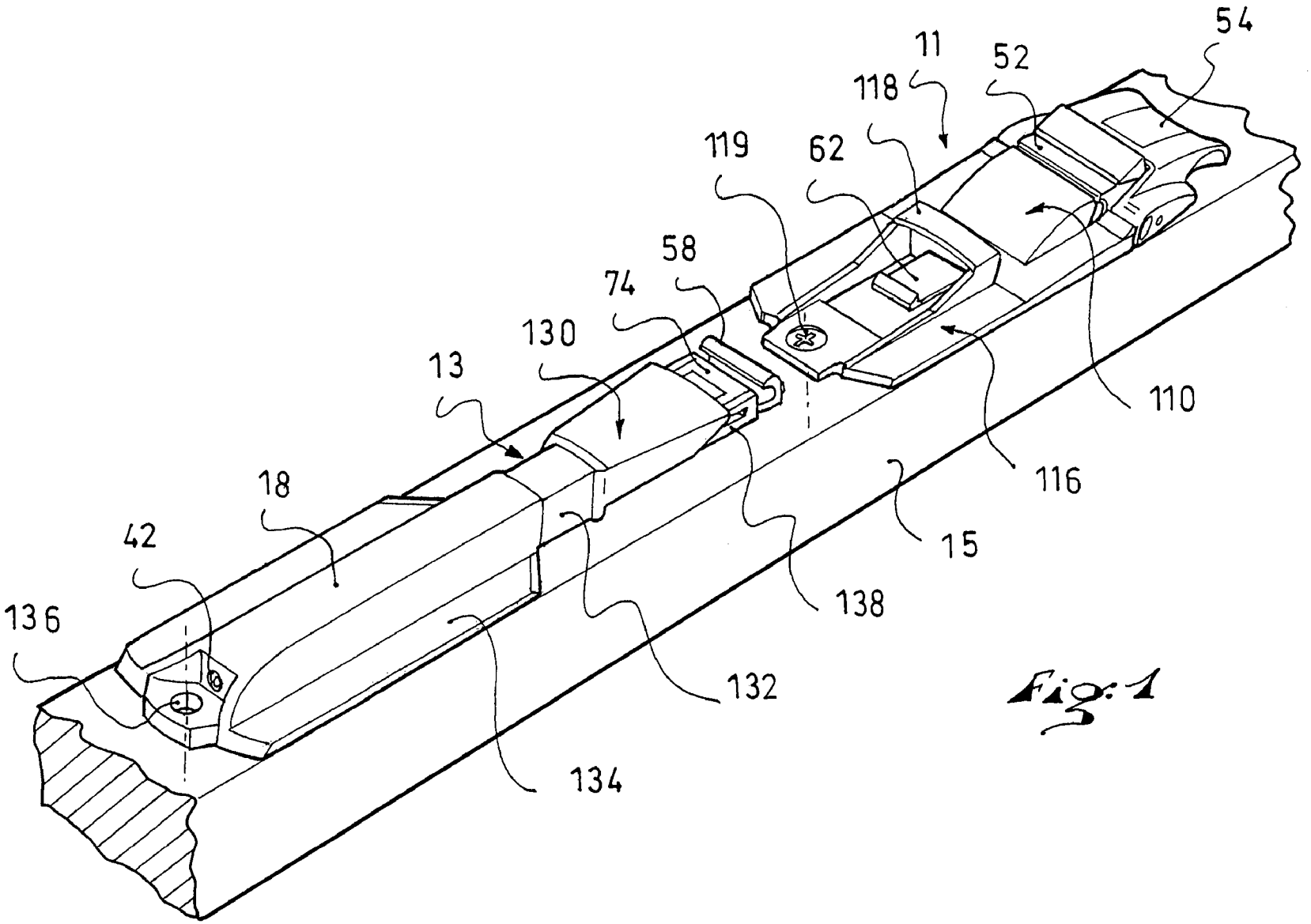
FIG. 1 is a schematic perspective view showing a binding device according to the invention, in which the retaining module is arranged on a sports article such as a ski, while the self-contained elastic return module is not yet fixed.

The invention will be described here in the case of a binding device that is more particularly adapted to cross-country skiing, although the invention is not intended to be limited to the particular details beyond that described in the claims. Thus, the drawing figures show a device 10 adapted to bind a boot 46 onto a ski 15.

In this case, the boot 46 (represented by broken lines in FIG. 3) has the conventional appearance of a cross-country ski boot having a flexible sole and provided on the bottom surface of its sole with a continuous longitudinal groove adapted to cooperate with a rib 18 for providing a guiding function of the binding device 10. The term "boot" is used herein to represent an article of footwear in a general, non-limiting sense. At its front end, the boot 46 has a front transverse fastening rod or pin 48 arranged across the groove and, behind the front rod/pin 48, a second transverse rod or pin 50 that is also arranged across the groove and located, for example, substantially in the area of the metatarsophalangeal articulation zone of the foot. In this embodiment, the rear rod 50 is arranged at the end of the front third of the length of the boot, which substantially constitutes the rear limit of the metatarsophalangeal articulation zone. The front rod 48 is preferably made in the form a cylindrical rod, although other shapes are encompassed by the invention.

Figure 2:
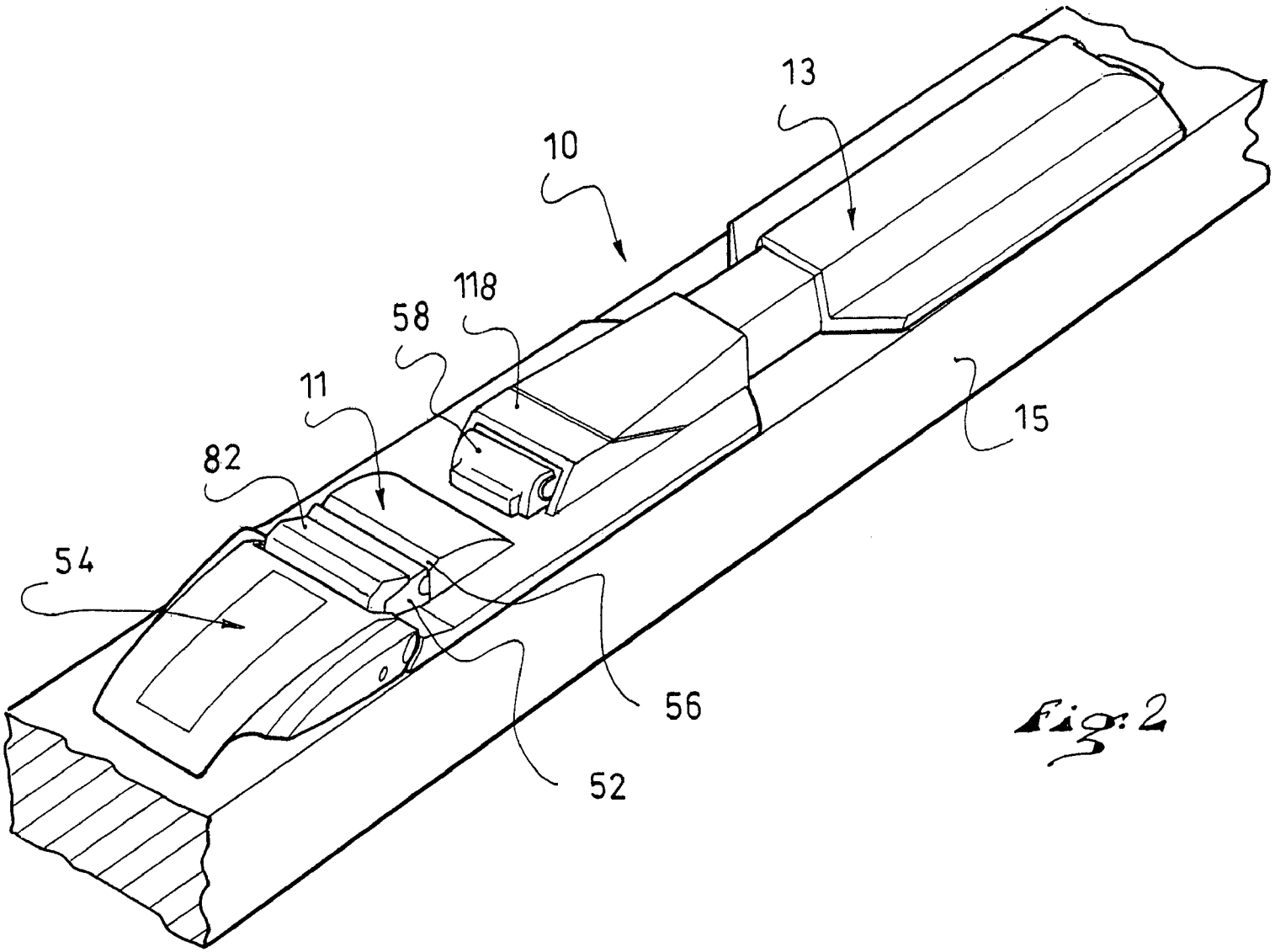
FIG. 2 is a schematic view, similar to that of FIG. 1 but inverted, in which the entire device is fixed on the ski.

According to one aspect of the invention, and as seen as FIG. 1, the binding device includes at least two sub-assemblies that can be distinguished as follows: a module 11 that incorporates a system for retaining the boot, and a module 13 that incorporates an elastic return system. The two modules are adapted to be assembled one behind the other, as shown in FIG. 2, to form the binding device.

In this embodiment of the invention, the retaining module is arranged at the front of the device, and it is arranged on an upper surface of the ski. The retaining module 11 can be an independent pre-assembled sub-assembly that is merely fixed on the ski, although it can be at least partially integrated into the ski. In the example shown, it can be seen that the retaining module 11 has a base 110 that forms a main body of the retaining sub-assembly, and which is adapted to be fixed on the ski, for example, by screws.

The principle of such a retaining system is described, for example, in the document FR 2 634 132, or, in a more closely related version, in the document EP 768 103 and U.S. Pat. No. 6,017,050, and is found in the cross-country ski binding devices marketed by Salomon S.A under the name of SNS Pilot®. The retaining system can either have a manual closure, as described, or an automatic closure.

Figure 7:
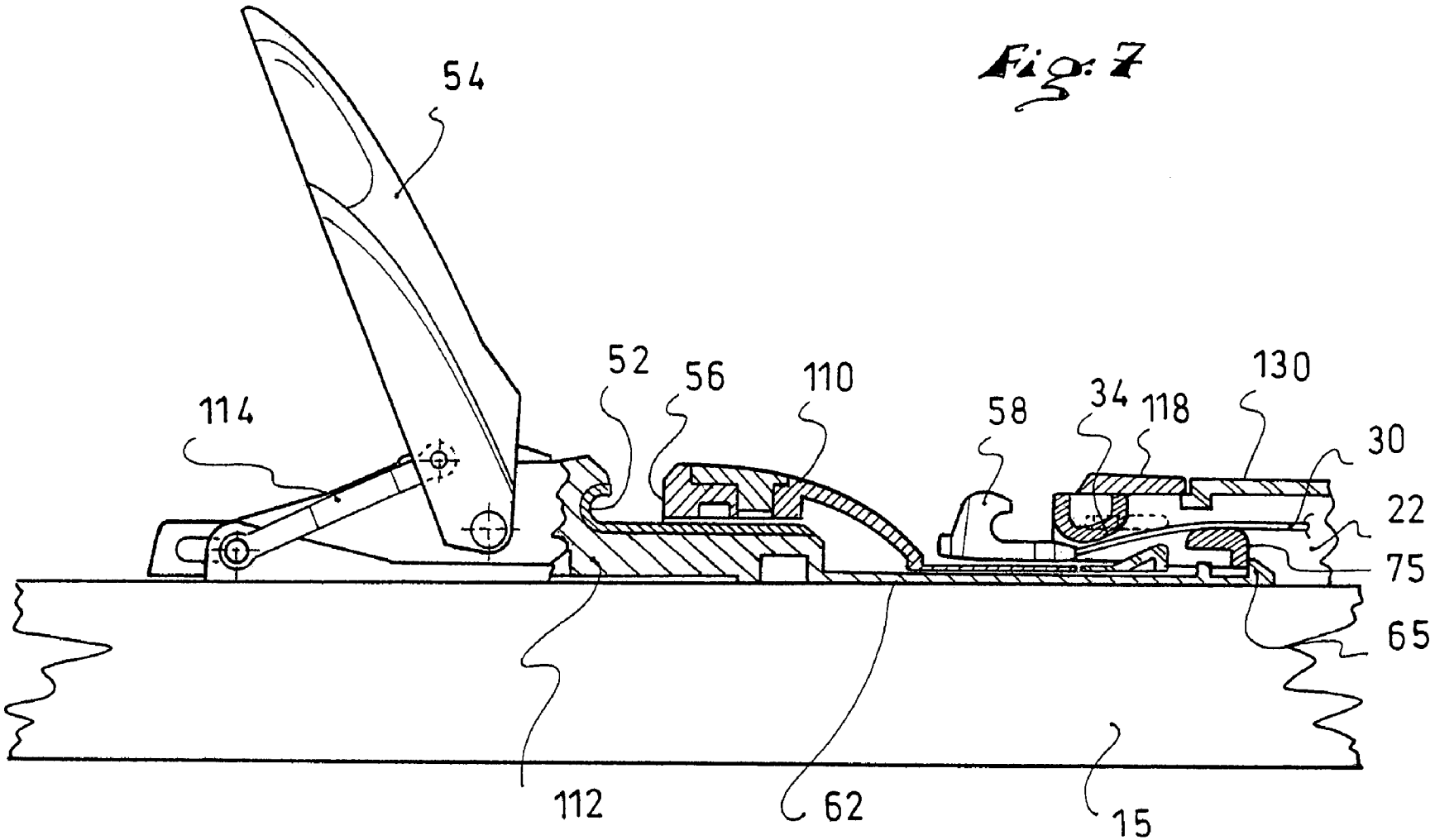
FIG. 7 is a schematic view of the binding device in an open state.

In the device shown in the drawing figures, the retaining system has a hook-shaped front jaw 52 that is longitudinally movable with respect to the base, and controlled by an open/close lever 54, which is articulated at the front end of the retaining module. A transverse edge 56 of the base is arranged directly behind the movable jaw 52 and constitutes a fixed jaw that locks the front rod 48 of the boot 46 when the movable jaw is in a setback locking position. Once the rod 48 is locked by the retaining system, the boot is retained on the sports article, but movable with respect to the sports article, along a rotational movement about the axis of the rod 48, between a low position in which the boot sole is in support on the sports article, and a high position in which the heel is separated from the sports article. When the lever 54 is lifted by pivoting, as shown in FIG. 7, the movable jaw 52 is displaced longitudinally (forward in the embodiment shown), causing the opening of the retaining system so as to enable the engagement or the release of the front rod 48 of the boot As is the case with the device in the document EP 768 103 and U.S. Pat. No. 6,017,050, the binding device 10 includes a system for the elastic return of the boot toward its low position, which is adapted to cooperate with the rear rod/pin 50 of the boot (see FIG. 3). According to an aspect of the present invention, this elastic return system is integrated into a pre-assembled, self-contained module 13 that is fixed on the sports article so as to be at least partially independent with respect to the remainder of the binding device, and in particular with respect to the retaining system. By definition, this pre-assembled module 13 incorporates a plurality of components that are connected to one another to ensure an efficient elastic return function.

The elastic return system and the corresponding module can assume various forms or shapes, similar to that of the system described in the document EP 768 103 and U.S. Pat. No. 6,017,050. However, according to yet another aspect of the invention, the elastic return system shown in the drawing figures (FIG. 3, in particular) includes at least one elastic member 20 that is directly or indirectly connected to the sports article, and a flexible linkage 30 that connects the elastic member to the boot 46, and which cooperates with at least one return member 34. In this embodiment, the flexible linkage 30 is directly connected to the boot by a hook 58. However, the invention could also apply in the case of a binding device in which the elastic return system is indirectly connected to the boot, by means of a connecting member, as described above.

In the example shown, the binding device 10 has a guiding rib 18 that is formed in a shape having a paralellepipedic or trapezoidal cross-section, and which extends longitudinally rearward, at the rear of the retaining system. In a known fashion, this guiding rib 18 is provided to cooperate with a groove having a complementary cross-section provided in the boot sole to guide the boot/binding assembly laterally. This guiding rib is formed by the geometry of a main body 130 forming a base of the rear return module 13.

Figure 3:
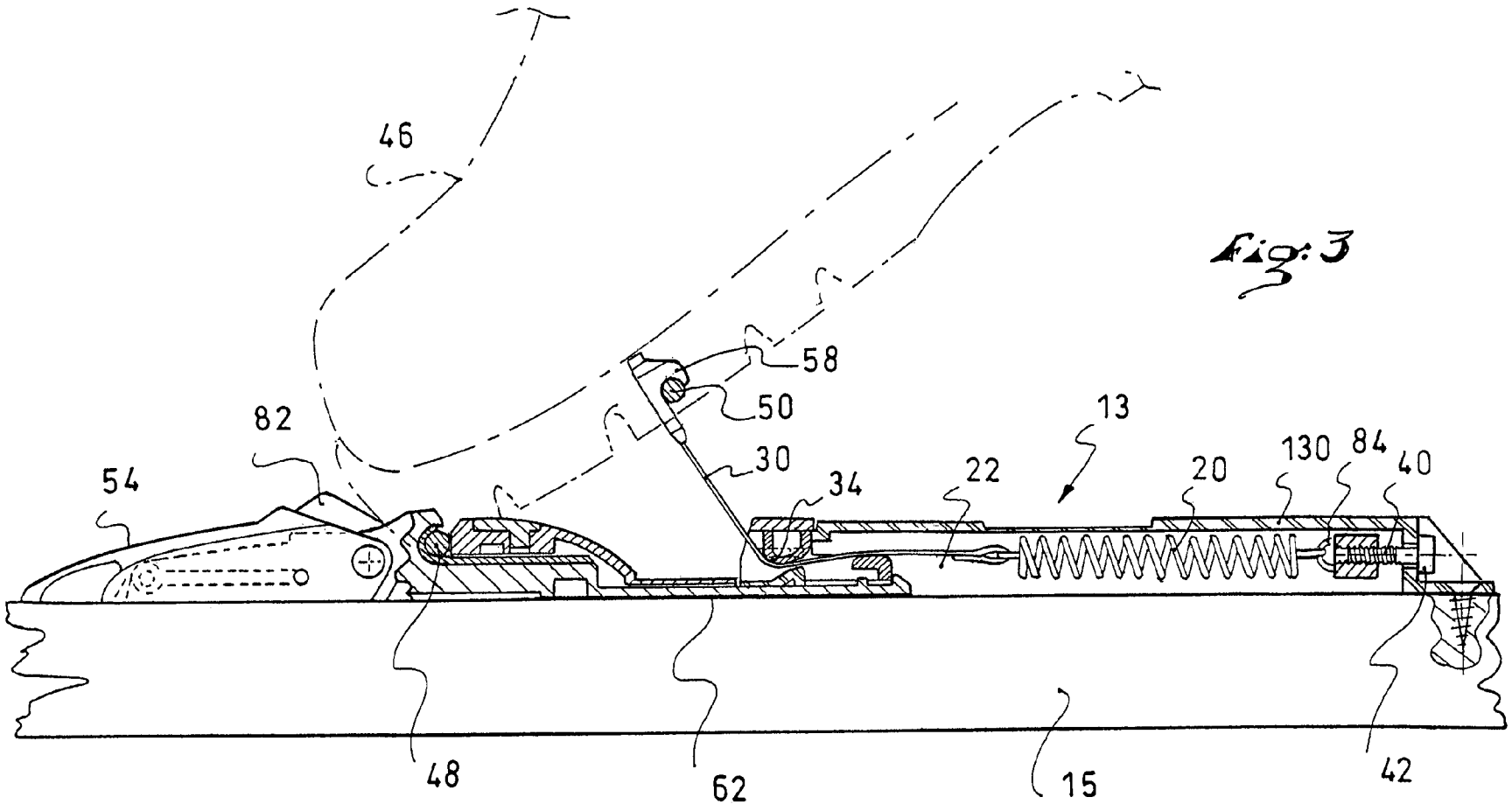
FIG. 3 is a general cross-sectional view along a vertical longitudinal plane schematically showing the device when a boot is fastened thereto, and in a high position.

Advantageously, the main part of the elastic return system is integrated within a housing 22 provided within this rib 18. In the example, the elastic member 20 is a traction spring that is horizontally and longitudinally arranged in the housing 22. The elastic member 20 is connected by a rear end to the base of the return module 13, and by its front end to the flexible linkage 30 that extends forward. The flexible linkage 30 is provided at its front end with a hook 58 made, for example, of metal or plastic. In this latter case, the hook can be co-molded on the front end of the flexible linkage so as to ensure a completely reliable anchoring. As can be seen in FIG. 3, the hook 58 extends outside of the housing 22, at the front end of the return module 13, and it is adapted to hook the rear rod 50 of the boot in order to connect the elastic member 20 to the boot 46, and therefore to enable the system to carry out its elastic return function.

The flexible linkage 30 passes beneath a return 34 (made, for example, in the form of a pulley or a curved surface, i.e., a guide) which is here arranged in the area of the front opening of the housing 22, and which is therefore borne by the return module 13.

Therefore, the functioning of the return system, when the boot is fixed on the device,is as follows. If the user lifts the heel of the boot, the boot making a rotational movement about the axis of the hinge defined by the front rod 48. At the same time, the rear rod 50 is raised along a substantially circular or arcuate path and, as shown in FIG. 3, drives the hook 58, causing the expansion of the spring 20 by means of the flexible linkage 30 (which takes support on the return 34).Thus,as shown in FIG. 3, in a high position of the boot, the flexible linkage 30 extends in a direction downwardly and rearwardly from the boot. In addition, in the embodiment illustrated in FIG. 3, the traction force exert along the length of the flexible linkage, to elastically return the boot to the low position, is applied to an area that substantially constitutes the rear limit of the metatarsophalangeal articulation zone.

One of the difficulties to overcome for the implementation of this return system is in enabling an easy and reliable fastening and unfastening of the hook 58 on the rear rod/pin 50 of the boot. Indeed, contrary to the elastic return system described in the document EP 768 103 and U.S. Pat. No. 6,017,050, the hook 58 here is arranged at the end of a flexible linkage 30 which, alone, cannot ensure an accurate and predetermined positioning of the hook 58 in the absence of the boot 46.

Figure 6:
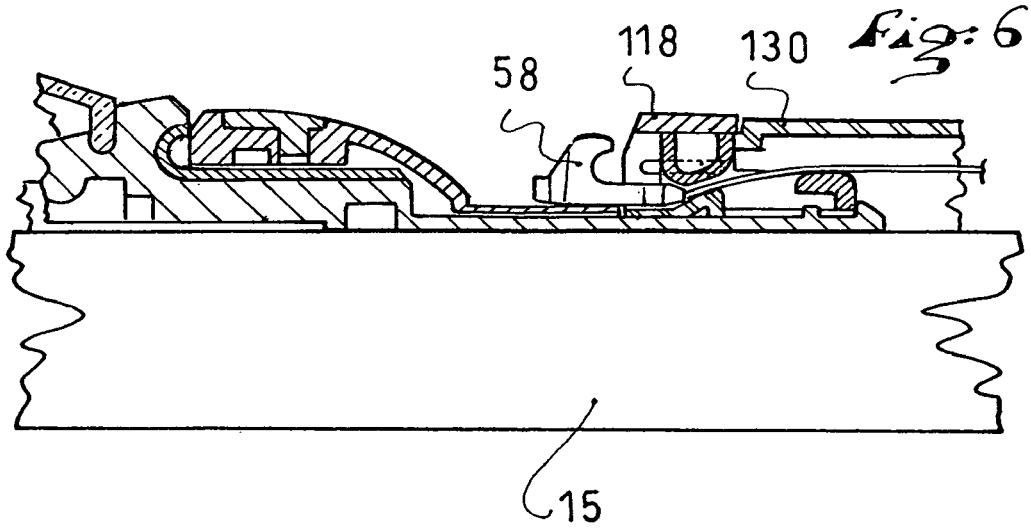
FIG. 6 is an enlarged view showing the junction zone between the retaining module and the elastic return system, once the binding device is completely mounted on the sports article.

Therefore, according to another aspect of the invention, the binding device has a mechanism that makes it possible to displace the hook between a resting position, shown in FIG. 6, and a waiting released position, as shown in FIG. 7.

Figure 8:
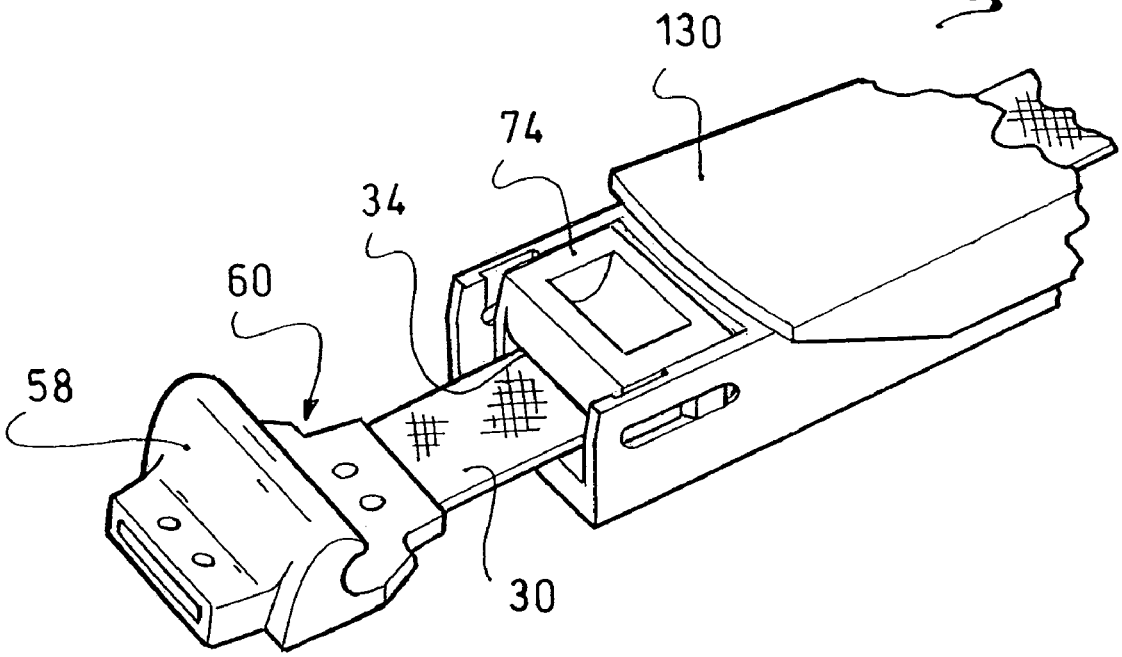
FIGS. 8 and 9 are exploded schematic perspective views showing the control of the displacement of the hook of the return system between its resting and released positions.
Figure 9:
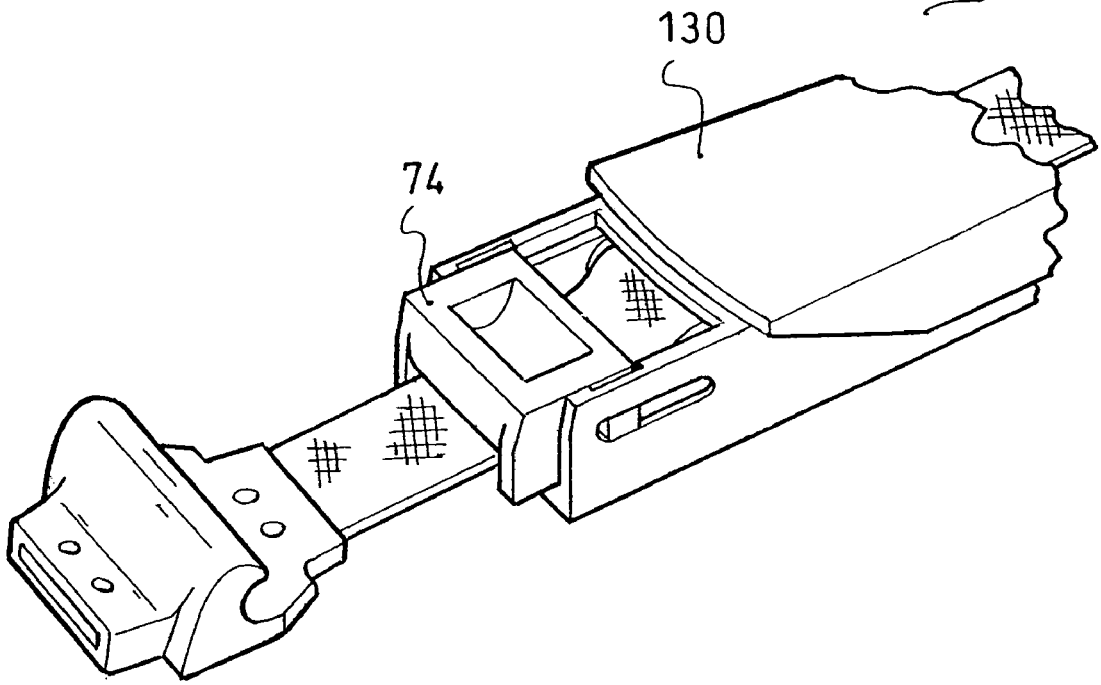

To this end, the return module 13 includes a slide 74 that is movably mounted in translation along the longitudinal direction at the front end of the housing 22, therefore at the front end of the module 13, as shown in FIGS. 8 and 9.

Furthermore, the hook 58 has a guiding portion 60 that is adapted to cooperate with complementary surfaces arranged at the front end of the slide 74. Thus, when the elastic member 20 brings the hook 58 back toward a resting position by means of the flexible linkage 30, in the absence of the boot, the hook 58 is guided and maintained in this predetermined position due to the cooperation of its guiding portion 60 and of the associated forms of the slide 74. These complementary shapes determine not only an accurate longitudinal position of the hook with respect to the slide 74 (and therefore also with respect to the main body of the module 13), they also preferably ensure a transverse blocking and a heightwise blocking of the hook.

As seen in the drawing figures, the slide 74 is longitudinally crossed by the flexible linkage 30, and one can see that the flexible linkage passes beneath a curved surface borne by the slide 74, this curved surface forming the return 34 mentioned above.

Furthermore, one can see that the system for retaining the binding device includes a drawer 62, or slide, a front portion of which is connected to the movable jaw 52 in order to follow the longitudinal movements thereof, which are controlled by the lever 54. Thus, as can be seen in FIG. 7, when the lever 54 is lifted to bring the binding in an open state, the drawer 62 advances longitudinally at the same time as the movable jaw 52. However, the drawer 62 includes a rear portion 64 which, in the setback position of the drawer 62, extends within the through opening of the housing 22, under the slide 74.

This rear portion 64 of the drawer 62 has a notch 65 that is housed behind a rear edge 75 of the slide 74, when the two subassemblies of the binding are assembled on the ski, such that, when the drawer 62 is controlled forward (i.e., when the user lifts the lever 54 to open the retaining system), the drawer 62 forwardly drives along the slide 74, by pulling the slide 74, from its resting position up to its waiting released position.

In this waiting position, shown in FIG. 7, the hook 58 is no longer capable of cooperating with the rear rod 50 of the boot, which can then be positioned (or on the contrary removed). This positioning is carried out by engaging the front rod 48 of the sole between the two jaws 52, 56 of the hinge, then by pivoting the sole of the boot 46 downward about the axis formed by the hinge. When the boot is in the low position, in support at the front and at the rear, the rear rod 50 has reached a position in which it is capable of being engaged by the hook 58. At that moment, the user can close the binding by lowering the lever 54, which has the effect of locking the jaws of the hinge around the front rod 48. At the same time, the drawer 62 moves back and, under the return effect of the spring 20, the hook 58 moves back until it hooks the rear rod 50 (which is not necessarily cylindrical) which is inserted on its path between its waiting and resting positions. The assembly is then latched, ready for the sporting activity.

When the user lowers the lever 54 to close the retaining system, causing the backward movement of the drawer 62, it is not necessary that the drawer 62 mechanically return the slide 74 toward the rear. Indeed, it can be sufficient for the hook 58 to automatically return the slide 74 toward the rear under the return effect of the elastic member 20.

The boot removal operation is carried out in an opposite manner. When the boot 46 is in the low position, the user opens the binding by lifting the lever 54, which causes the opening of the jaws 52, 56, on the one hand, and the advance of the drawer 62, on the other hand. By means of its rear portion 64, the drawer 62 drives the slide 74 and the hook 58 forward, which releases the rear rod 50 of the boot.

In practice, boot insertion can be undertaken in another manner, benefiting from the ramp shape of the upper surface of the hook 58. Indeed, the front rod 48 can be latched in the retaining system as described hereinabove, without the boot laying flat on the sports article. In this case, the hook 58 cannot get hooked onto the rear rod 50. However, the boot is then latched so that it can only make one circular or arcuate movement about the axis of the front rod 48.Therefore, by lowering the foot in order to bring it into contact with the sports article, the user will bring the rear rod 50 into contact with the upper surface of the hook, which is then in the resting position. Under the effect of the user's weight, the rear rod cooperates with the ramp shape of the hook 58 in order to cause the latter to advance, against the elastic return force, until fastening occurs by a mere snap engagement.

Preferably, the flexible linkage 30 is inextensible, or substantially inextensible. For example, the linkage can be a metallic cable or a fiber cable with very low extensibility, such as, for example, a cable made of aramide fibers. It is also contemplated according to the invention that the linkage can be made in the form of a band. This traction band can be made, for example, in the form of a metallic strip or an assembly of parallel fibers embedded in a polymeric material. Preferably, the linkage is sufficiently supple and flexible to not produce any notable elastic effect, and in particular to support a return angle of approximately 90 degrees. As a result, the suppleness of the linkage 30 must be mainly appreciated as being a flexional suppleness about the return axis. This suppleness of the linkage cannot only be local, because the linkage is displaced with respect to the return. Conversely, particularly if the supple linkage is a band, this band will not be flexionally supple about an axis that is perpendicular to the plane of the band, but this will not prevent the band from being considered as supple in the context of the invention if it does not offer any significant resistance to flexion about the axis of the return.

In certain cases, it can be advantageous to provide the return system with an adjustment mechanism in order to provide the user with the possibility to increase or decrease the intensity of the elastic return force so as to adapt it to the user's style in the practice of his/her sport.

In the example shown, the adjustment mechanism merely varies the stiffness of the elastic member, by imparting thereon a more or less substantial pre-stress. Thus, in the illustrated embodiment, the rear end of the spring is hooked on a loop or ring 84 that is mounted in the housing 22 on a screw 40, while being rotationally blocked about the axis of the screw. The rear end of the screw 40 extends outside of the housing 22 and has the form of a screw head 42 so as to enable the user to control the rotation of the screw 40 about its axis. In this way, with this screw-nut system, the user can cause the longitudinal displacement of the ring 84 in the housing in order to cause a more or less substantial pre-stress of the spring 20. In an alternative embodiment (not shown), one can provide that the guide rib 18 include a window which would enable the user to see the position of the ring, and which would therefore enable the user to evaluate the pre-stress value of the spring. Graphical reference markings could be associated with this window.

This elastic return system is particularly advantageous because it makes it possible to house the elastic member in a zone of the device where it does not hinder the kinematics and the rolling movement of the foot allowed by the binding. In this case, the elastic return module 13 is arranged at the rear of the retaining system 11, but one could also provide that it be arranged at the front thereof.

As the flexible linkage extends along a return, one further obtains a better orientation of the direction of the return force, which follows the direction of the portion of the supple linkage that extends between the return and the boot. This orientation is substantially parallel to that of the trajectory that the boot must follow toward its low position.

In the binding device according to the invention, the return system provides a return force that is completely controlled, in particular because the boot is retained by an independent system, i.e., a system that is independent of the elastic return system. Thus, one can provide that the lift begin with a small initial return force, and can provide to then "program" the development curve of this force as a function of the boot lift angle. To this end, the elastic member can be constituted by a plurality of serial and/or parallel springs, and/or it can also incorporate elastomeric elements having another type of force/deformation curve.

Furthermore, in any case, the elastic return system can be completed by other elastic systems or abutment systems.

Thus, as shown in FIG. 3, an end of travel abutment 82 can be provided, which only intervenes at a predetermined lift angle of the boot. This abutment 82 can be a rigid abutment that limits the travel of the boot, or an elastic abutment made in the form of an elastic buffer of the type of that described in the document FR 2 650 192 and in U.S. Pat. No. 5,152,546, which then provides a flexible abutment effect as well as a supplemental elastic return force. The abutment 82, whether rigid or elastic, can cooperate directly with the boot. The purpose of this abutment 82 is to introduce a reference element through which the user can "recognize" or "feel" a reference position in the movement of the user's foot with respect to the sports article.

The abutment 82 shown in the drawing figures is fixed, but one could provide that its longitudinal position be adjustable by the user, particularly so that the user can adapt the reference position to the length of his/her stride.

In the case of an elastic abutment, the abutment provides a return force that is complementary to that of the main return system.

Figure 4:
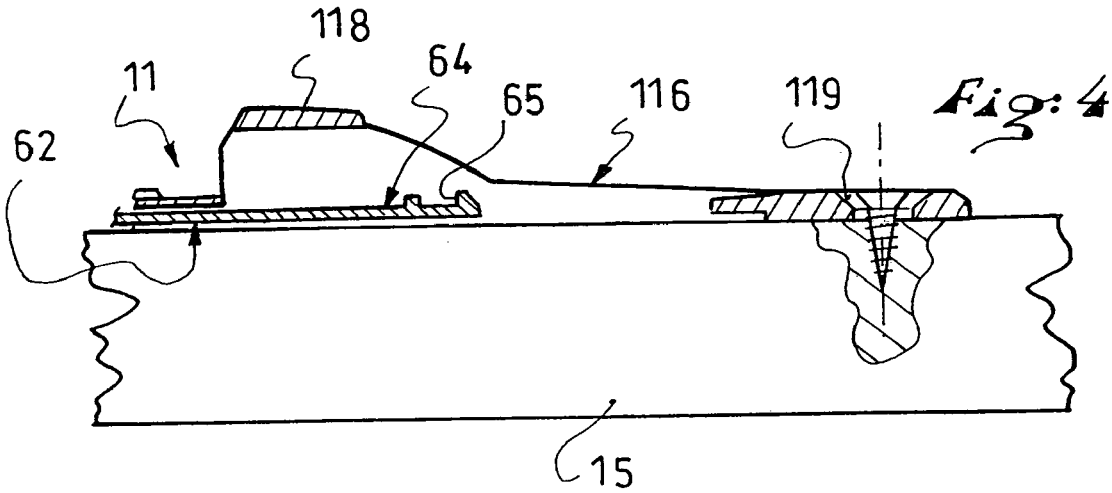
FIG. 4 is a schematic and partial longitudinal cross-sectional view of the rear portion of the retaining module mounted on the sports article.

In terms of construction, the retaining module 11 has a main body that forms a base 110, a movable body 112 that forms both the movable jaw 52 and the drawer 62, the lever 54 that is articulated in the movable body, and a connecting rod 114 which, as seen in FIG. 7, is articulated by its front end on the main body 110 and by its rear end on the lever 54. As shown in FIG. 1, the main body 110 of the retaining module 11 has a rear extension 116 that extends rearward of the portion forming a fixed jaw 56 and which includes an arch 118. The rear extension is ended by a rear plate that is provided with an opening for the passage of a screw 119, enabling the main body 110 to be fixed on the upper surface of the ski. The rear extension 116 is shown more particularly in FIG. 4, where it can be seen that the rear end 64 of the drawer 62 is adapted to extend rearward of the arch 118, but forward of the rear plate in which the opening for the fixing screw 119 is arranged. The main body 110 further has other fixing means that are arranged in its front portion, but which are not shown in the drawing. Preferably, this assembly forming the retaining module 11 is pre-assembled so as to form a unitary, or one-piece, subassembly of the binding device.

Figure 5:
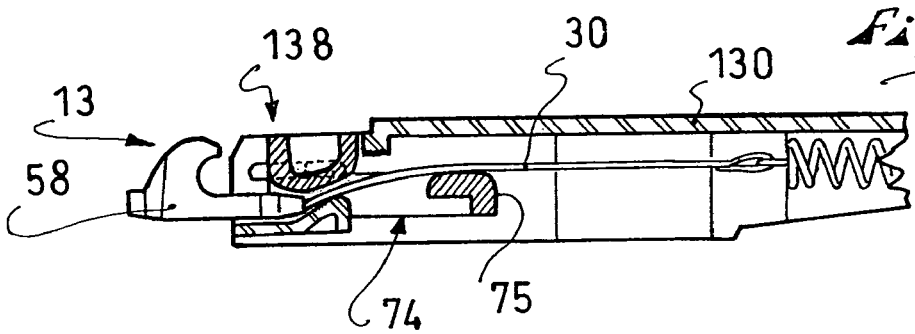
FIG. 5 is a view, similar to FIG. 4, showing the front portion of the elastic return module prior to its mounting on the sports article.

Similarly, the return module 13 has a main body 130 which also forms a base through which the return module 13 is at least partially fixed on the ski. This main body thus has an axial portion in the form of a hollow beam 132 that forms, on the outside, the guiding rib 18 and, on the inside, the housing 22. At the rear, this axial beam 132 is bordered, transversely on both sides, by two horizontal flanges 134 adapted to come in support on the upper surface of the ski. FIG. 1 shows the possibility for the axial beam 132 to have, at its rear end, an opening 136 for the passage of a screw adapted to participate in fixing the return module 13 onto the ski. This opening is advantageously blocked by a cover. At its front end, the axial beam 132 of the main body 130 forms a nose 138, which is opened upward and forward, and in which the slide 74 is slidably mounted. According to one aspect of the invention, the return module 13, which includes the main body 130, the spring 20, the flexible linkage 30, the hook 58 and the slide 74, is preassembled to form a unitary, or one-piece, subassembly of the binding device 10, as shown in FIG. 5.

FIG. 6 shows in detail how the return module 13 is mounted at the rear of the retaining module 11. Indeed, it can be seen that the nose 138 of the return module is engaged beneath the arch 118 which thus blocks it toward the top and along the transverse direction. However, one also sees that the hook 58 extends beyond the front of the arch 118. At the same time, one sees that when the nose 138 of the return module 13 is engaged beneath the arch 118, the slide 74 must be correctly positioned at the front of the notch 65 of the rear end 64 of the drawer 62, in order to ensure a meshing effect between the notch 65 and the rear edge 75 of the slide 74 when the retaining system 11 and the elastic return system 13 are arranged on the sports article.

In the embodiment shown, it is also to be understood that the arch 118 of the retaining module 11 partially ensures the fixing of the return module 13, this fixing being completed by the fact that the main body 130 of this return module, which is in support on the upper surface of the ski, is also directly fixed on the ski by its rear portion due to a screw that is screwed through the opening 136. This solution, through which the unitary elastic return module is fixed only partially independently on the sports article, makes it possible to simplify the mounting of the return module 13. However, one could also provide that the fixing of the return module be completely independent of that of the retaining module.

In the example shown, one can see that the return module 13 covers and hides the rear plate of the extension 116, thus hiding the fixing screw 119. The design of the device in two self-contained subassemblies makes it possible to arrange a fixing means substantially in the middle of the device, in a zone that is no longer accessible once the return module is positioned. In a one-piece construction, such an arrangement of the fixing means would be problematic, simply due to the lack of access to the fixing means.

The binding device according to the invention is therefore designed such that the elastic return module is capable of being dismounted from the sports article independently of the retaining system. In this way, it is possible to replace one elastic return module with another, either of the same type (for example, when an element of the return module is broken), or of a different type. In this latter case, for example, the same retaining system can be provided to be used with return modules incorporating elastic members having a different stiffness. The return modules can also be provided to use different elastic return systems. Indeed, one can provide to obtain a self-contained return module on the basis of the elastic return system having a connecting rod, as described in the prior art document EP 768 103 and in U.S. Pat. No. 6,017,050.

The design of a binding device having a return module can thus make it possible to standardize the retaining system between two types of binding, allowing a greater possibility of choice for the user and/or enabling the manufacturer to produce these systems at lower costs.

The invention claimed is:

1. A device for binding a boot to a sports article, the device comprising:

a retaining system for connecting the boot to the sports article for movement relative to the sports article between a low position and a high position; and an elastic return system for the elastic return of the boot toward its low position, the elastic return system being part of a pre-assembled unitary module, the elastic return system comprising at least one elastic member connected to the sports article and a flexible linkage flexing during said movement of the boot during use of the device, said linkage connecting the elastic member directly or indirectly to the boot;

in said high position of the boot, at least a portion of the flexible linkage extending in a single direction both downward and rearward from the boot;

the retaining system retaining the boot independently of the elastic return system.

2. A device according to claim 1, wherein:

the retaining system comprises a movable jaw and a fixed jaw, said movable jaw being movable toward said fixed jaw for locking the boot to the sports article against movement other than said movement between the low position and the high position.

3. A device according to claim 1, wherein:

in said high position of the boot, the flexible linkage extends in a direction downwardly and rearwardly from the boot.

4. A device according to claim 1, wherein:

the flexible linkage comprises a linkage element that bends during said movement of the boot between the low position and the high position.

5. A device according to claim 4, wherein:

the boot extends from a rear of the boot to a front of the boot in a direction along a longitudinal plane while the boot is retained by the retaining system;

the flexible linkage of the elastic return system comprises a flexible element extending in said direction.

6. A device according to claim 1, wherein:

the elastic return system further comprises a return element;

the flexible linkage of the elastic return system comprises a linkage element guided by the return element, said linkage element being displaced in a direction extending along a length of said linkage element to and from the return element during said movement of the boot between the low position and the high position.

7. A device for binding a boot to a sports article, the device comprising:

a retaining system for connecting the boot to the sports article for movement relative to the sports article between a low position and a high position and for preventing a rearward release of the boot; and an elastic return system for the elastic return of the boot toward its low position, said elastic return system being structured and arranged to apply an elastic return force extending in a direction from an area within a front third of a length of the boot;

the elastic return system comprising at least one elastic member connected to the sports article, and an elongated linkage having a length and being flexible within a plane extending along said length, said elongated linkage connecting the elastic member directly or indirectly to the boot;

the retaining system retaining the boot independently of the elastic return system;

the elastic return system being part of a pre-assembled unitary module;

the pre-assembled unitary module being at least partially independently fixed on the sports article independent of the retaining system.

8. A device according to claim 7, wherein:

the pre-assembled unitary module is partially fixed on the sports article with cooperation with the retaining system.

9. A device according to claim 7, wherein:

the pre-assembled unitary module comprises a base, the elastic return module being adapted to be fixed to the sports article via the base.

10. A device according to claim 7, wherein:

the retaining system comprises at least one member for anchoring on the sports article, said member being covered by the pre-assembled unitary module when the module is fixed on the sports article.

11. A device according to claim 7, further comprising:

at least one return member;

the flexible linkage being in cooperative engagement with the return member.

12. A device according to claim 11, wherein:

the elastic return system comprises a hook connected to the flexible linkage, and which is adapted to hook a fastening rod of the boot.

13. A device according to claim 12, wherein:

in the absence of the boot, the hook is automatically brought by the elastic return system toward a resting position that is predetermined by the cooperation of the hook with complementary shapes of the device.

14. A device according to claim 13, further comprising:

an opening mechanism that drives the hook from the resting position toward a waiting released position that enables the positioning of a boot, and wherein, when the hook returns to the resting position, the fastening rod of the boot is arranged on the path of the hook in order to ensure that the hook engages the fastening rod.

15. A device according to claim 14, wherein:

the unitary elastic return module comprises a slide that is movably mounted on the module, and on which the shapes complementary to those of the hook are arranged; and displacement of the hook, from its resting position to its waiting released position, is controlled by a corresponding displacement of the slide.

16. A device according to claim 15, wherein:

the displacement of the slide is controlled by a mechanism for controlling the opening/closure of the retaining system.

17. A device according to claim 7, wherein:

the retaining system comprises jaws adapted to receive a rod for articulating the boot about an axis of the rod in the manner of a hinge.

18. A device according to claim 7, wherein:

in addition to the elastic return system, the device comprises a rigid or elastic abutment acting at the end of the boot travel.

19. A device according to claim 7, wherein:

the pre-assembled unitary module comprises a mechanism for adjusting the intensity of the elastic return effect.

20. A device according to claim 19, wherein:

the mechanism for adjusting the intensity of the elastic return effect makes it possible to adjust a more or less substantial pre-stress of the elastic member.

21. A device according to claim 7, wherein:

the retaining system comprises at least one member for anchoring on the sports article, said member being covered by the pre-assembled unitary module when the elastic return module is fixed on the sports article.

22. A device according to claim 7, wherein:

the elastic return system comprises a flexible linkage, said flexible linkage comprising having a length along which a traction force is exerted as the boot is moved between the low position and high position, said flexible linkage being flexible within a plane extending along a length of said flexible linkage;

the elastic return system further comprises a guide for the flexible linkage, the guide guiding the flexible linkage in a change of direction of the flexible linkage between the elastic member and the boot.

23. A device according to claim 7, wherein:

the device is adapted to be used with a boot having a first connecting member and a second connecting member, said connecting members being longitudinally spaced-apart;

the retaining system includes a jaw for engagement with the first connecting member for connecting the boot to the sports article;

the elastic return system of the pre-assembled unitary module includes an engagement member for engaging with the second connecting member of the boot;

the retaining system, including said jaw, is adapted to be fixed to the sports article before the pre-assembled unitary module, including said engagement member, is mounted upon the sports article.

24. A device according to claim 23, wherein:

the first and second connecting members of the boot are first and second transversely extending pins;

the engagement member of the elastic return system is a hook adapted to engage said second transversely extending pin of the boot.

25. A device according to claim 7, wherein:

the flexible linkage comprises an elongated member capable of flexing during use of the device, a traction force being exerted along a length of the flexible elongated member as the boot is moved between the low position and the high position.

26. A device according to claim 25, wherein:

the flexible elongated member is a flexible band.

27. A device according to claim 25, wherein:

the elastic return system further comprises a guide for the elongated member, the guide guiding movement of the elongated member along a length of the elongated member as the boot is moved between the low position and the high position.

28. A device according to claim 7, wherein:

the elastic return system comprising a flexible linkage extending to attachment with the boot during use of the device;

in said high position of the boot, the flexible linkage extends in a direction downwardly and rearwardly from the boot.

29. A device according to claim 7, wherein:

the elastic return system being structured and arranged to apply an elastic return force extending in a direction from substantially a metatarsophalangeal articulation of the boot.

30. A device according to claim 7, wherein:

the device is adapted to be used with a boot having a sole with a front attachment and a rear attachment;

the retaining system is structured and arranged to be connected to said front attachment;

the elastic return system is structured and arranged to be connected to said rear attachment.

31. A device according to claim 30, wherein:

the front attachment is a first transversely extending pin;

the rear attachment is a second transversely extending pin.

32. A device for binding a boot to a sports article, the device comprising:

a retaining system for connecting the boot to the sports article for movement relative to the sports article between a low position and a high position and for preventing a rearward release of the boot; and an elastic return system for the elastic return of the boot toward its low position, said elastic return system being structured and arranged to apply an elastic return force extending in a direction from an area within a front third of a length of the boot;

the elastic return system comprising at least one elastic member connected to the sports article, and an elongated linkage having a length and being flexible within a plane extending along said length, said elongated linkage connecting the elastic member directly or indirectly to the boot;

the retaining system retaining the boot independently of the elastic return system;

the elastic return system being part of a pre-assembled unitary module;

the pre-assembled unitary module being adapted to be dismounted from the sports article independently of the retaining system.

33. A device according to claim 32, wherein:

the device is adapted to be functional with any one of a plurality of different unitary return modules incorporating distinct elastic return systems.

34. A device according to claim 33, wherein:

in said high position of the boot, the flexible linkage extends in a direction downwardly and rearwardly from the boot.

35. A device according to claim 32, wherein:

the retaining system comprises at least one member for anchoring on the sports article, said member being covered by the pre-assembled unitary module when the module is fixed on the sports article.

36. A device according to claim 32, wherein:

the device is adapted to be used a with boot having a first connecting member and a second connecting member, said connecting members being longitudinally spaced-apart;

the retaining system includes a jaw for engagement with the first connecting member for connecting the boot to the sports article;

the elastic return system of the pre-assembled unitary module includes an engagement member for engaging with the second connecting member of the boot;

the retaining system, including said jaw, is adapted to be fixed to the sports article before the pre-assembled unitary module, including said engagement member, is mounted upon the sports article.

37. A device according to claim 36, wherein:

the first and second connecting members of the boot are first and second transversely extending pins;

the engagement member of the elastic return system is a hook adapted to engage said second transversely extending pin of the boot.

38. A device according to claim 32, wherein:

in said high position of the boot, the flexible linkage extends in a direction downwardly and rearwardly from the boot.

39. A device according to claim 32, wherein:

the elastic return system being structured and arranged to apply an elastic return force extending in a direction from substantially a metatarsophalangeal articulation of the boot.

40. A device according to claim 32, wherein:

the device is adapted to be used with a boot having a sole with a front attachment and a rear attachment;

the retaining system is structured and arranged to be connected to said front attachment;

the elastic return system is structured and arranged to be connected to said rear attachment.

41. A device according to claim 40, wherein:

the front attachment is a first transversely extending pin;

the rear attachment is a second transversely extending pin.

42. A device for binding a boot to a sports article, the device compnsing:

a retaining system for connecting the boot to the sports article for movement relative to the sports article between a low position and a high position;

the retaining system comprising an open/close control mechanism, said control mechanism cooperating with a member for controlling the fastening/unfastening of the elastic return system on the boot;

the open/close control mechanism of the retaining system comprising means for meshing with the fastening/unfastening control member of the elastic return system, said meshing means being active when the retaining system and the elastic return system are arranged on the sports article;

an elastic return system for the elastic return of the boot toward its low position;

the retaining system retaining the boot independently of the elastic return system;

the elastic return system being part of a pre-assembled unitary module.

43. A device for binding a boot to a sports article, the device comprising:

a retaining system for connecting the boot to the sports article for movement relative to the sports article between a low position and a high position; and an elastic return system for the elastic return of the boot toward its low position;

the retaining system functioning at least partially independently of the elastic return system;

the elastic return system being part of a pre-assembled unitary module;

the retaining system further comprising an open/close control mechanism, said control mechanism cooperating with a member for controlling the fastening/unfastening of the elastic return system on the boot;

the open/close control mechanism of the retaining system comprising means for meshing with the fastening/unfastening control member of the elastic return system, said meshing means being active when the retaining system and the elastic return system are arranged on the sports article.

44. A device for binding a boot to a sports article, the device comprising:

a retaining system for connecting the boot to the sports article for movement relative to the sports article between a low position and a high position;

an elastic return system for the elastic return of the boot toward its low position, the elastic return system being part of a pre-assembled unitary module, the elastic return system comprising at least one elastic member connected to the sports article and a flexible linkage flexing during said movement of the boot during use of the device, said linkage connecting the elastic member directly or indirectly to the boot;

the boot extending rearward from a front of the boot to a rear of the boot while the boot is retained by the retaining system;

said elastic member being structured and arranged to apply a force to the boot, said force having at least a rearward component;

the retaining system retaining the boot independently of the elastic return system;

the retaining system comprising a movable jaw and a fixed jaw, said movable jaw being movable toward said fixed jaw for locking the boot to the sports article against movement other than said movement between the low position and the high position.

* * * * *